US008997520B2

(12) United States Patent
Guillard et al.

(10) Patent No.: US 8,997,520 B2
(45) Date of Patent: Apr. 7, 2015

(54) METHOD AND DEVICE FOR PRODUCING AIR GASES IN A GASEOUS AND LIQUID FORM WITH A HIGH FLEXIBILITY AND BY CRYOGENIC DISTILLATION

(75) Inventors: Alain Guillard, Paris (FR); Patrick Le Bot, Vincennes (FR); Xavier Pontone, Saint Maur des Fosses (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 1316 days.

(21) Appl. No.: 12/530,840

(22) PCT Filed: Feb. 26, 2008

(86) PCT No.: PCT/FR2008/050314

§ 371 (c)(1),
(2), (4) Date: Jan. 15, 2010

(87) PCT Pub. No.: WO2008/110734

PCT Pub. Date: Sep. 18, 2008

(65) Prior Publication Data

US 2011/0120186 A1 May 26, 2011

(30) Foreign Application Priority Data

Mar. 13, 2007 (FR) ..... 07 53789

(51) Int. Cl.
*F25J 3/00* (2006.01)
*F25J 3/04* (2006.01)

(52) U.S. Cl.
CPC ..... *F25J 3/0429* (2013.01); *F25J 3/04775* (2013.01); *F25J 3/04781* (2013.01);

(Continued)

(58) Field of Classification Search
CPC ... F25J 3/04018; F25J 3/04024; F25J 3/0429; F25J 3/04296; F25J 3/04303; F25J 3/04381; F25J 3/04812; F25J 3/04836; F25J 3/0483; F25J 3/04054; F25J 3/04048; F25J 2230/08; F25J 2230/20; F25J 2230/30; F25J 2240/02; F25J 2240/04; F25J 2240/10; F25J 3/04775; F25J 3/04781
USPC ..... 62/643–647, 656
See application file for complete search history.

(56) References Cited

U.S. PATENT DOCUMENTS 5,123,249 A 6/1992 Buttle
5,157,926 A * 10/1992 Guilleminot ..... 62/646

(Continued)

FOREIGN PATENT DOCUMENTS

AU 655630 1/1995
DE 3012062 10/1981

(Continued)

OTHER PUBLICATIONS

Search Report for FR 0753789.

(Continued)

*Primary Examiner* — Frantz Jules
*Assistant Examiner* — Keith Raymond
(74) *Attorney, Agent, or Firm* — Justin K. Murray

(57) ABSTRACT

A method of producing at least one air gas using cryogenic distillation is provided. The expanded streams coming from the two turbines are combined and then split into two fractions. The first fraction is sent to the medium-pressure column of the system in gaseous form, whereas the second fraction is returned to the cold end of the heat exchange line. At a temperature T4 below −100° C. and above T2, the second fraction is sent to a turbine where it expands up to a temperature T5, forming an air stream. This air stream is then warmed in the heat exchange line before being discharged into the atmosphere, so that the distillation is not disturbed. A liquid product is withdrawn from the column system as final product. The sole liquid product from the apparatus is liquid oxygen, but of course other products may be produced.

21 Claims, 2 Drawing Sheets

(52) U.S. Cl.
CPC ..... *F25J3/04836* (2013.01); *F25J 3/04054* (2013.01); *F25J 3/0409* (2013.01); *F25J 3/04175* (2013.01); *F25J 3/04296* (2013.01); *F25J 3/04303* (2013.01); *F25J 3/04393* (2013.01); *F25J 3/04812* (2013.01); *F25J 3/04957* (2013.01); *F25J 2230/24* (2013.01); *F25J 2230/40* (2013.01); *F25J 2240/04* (2013.01)

(56) References Cited

U.S. PATENT DOCUMENTS

| | | | | |
|---|---|---|---|---|
| 5,379,598 | A * | 1/1995 | Mostello | 62/646 |
| 5,400,600 | A * | 3/1995 | Grenier | 62/646 |
| 5,475,980 | A * | 12/1995 | Grenier et al. | 62/646 |
| 5,596,885 | A * | 1/1997 | Grenier | 62/646 |
| 5,758,515 | A * | 6/1998 | Howard | 62/646 |
| 5,802,873 | A * | 9/1998 | Howard | 62/646 |
| 5,806,341 | A | 9/1998 | Rathbone | |
| 7,076,971 | B2 | 7/2006 | Jaouani et al. | |
| 7,272,954 | B2 * | 9/2007 | Brugerolle et al. | 62/646 |
| 7,437,890 | B2 * | 10/2008 | Howard | 62/646 |
| 2004/0115051 | A1 * | 6/2004 | O'Reilly et al. | 415/209.2 |
| 2004/0221612 | A1 | 11/2004 | Jaouani et al. | |
| 2006/0277944 | A1 | 12/2006 | Le Bot et al. | |
| 2009/0078001 | A1 * | 3/2009 | Le Bot et al. | 62/646 |

FOREIGN PATENT DOCUMENTS

| | | |
|---|---|---|
| EP | 0420725 | 4/1991 |
| EP | 0504029 | 9/1992 |
| FR | 2688052 | 9/1993 |
| GB | 1500610 | 2/1978 |

OTHER PUBLICATIONS

PCT/FR2008/050314, International Search Report, Jun. 6, 2011 (WO 2008/110734 A3).
PCT/FR2008/050314, Written Opinion of the International Searching Authority, Jun. 6, 2011.

* cited by examiner

METHOD AND DEVICE FOR PRODUCING AIR GASES IN A GASEOUS AND LIQUID FORM WITH A HIGH FLEXIBILITY AND BY CRYOGENIC DISTILLATION

This application is a §371 of International PCT Application PCT/FR2008/050314, filed Feb. 26, 2008.

BACKGROUND

The conventional methods for producing air gases in liquid or gaseous form had distinct method architectures. Thus, there could be found:

- an air separation apparatus that produced the main constituents ($O_2$, $N_2$, Ar) at atmospheric pressure or slightly higher;
- a step of compressing the products using compressors;
- an independent nitrogen-liquefaction cycle that allowed all or some of each of the constituents to be produced in liquid form if necessary.

This configuration allowed a great deal of flexibility of use because each of the three "functions" implemented (separation, compression, liquefaction) could be performed or halted independently without affecting the operation of the other two.

Nonetheless, this configuration suffers from a significant lack of competitiveness, bearing in mind the very high cost of this design which requires one apparatus per function.

The most recent methods for producing air gases, which we term integrated methods, have the advantage that they can combine these three functions into a single equipment. So-called "pumped" apparatuses, including cycles of expanding air or possibly nitrogen, allow one and the same equipment to produce the constituents of air in pressurized gaseous form and in liquid form.

Among these, the methods involving staged vaporization in order to deliver products under pressure, as described in patent EP-A-0504029 or alternatively FR-A-2688052, are particularly attractive because they allow these functions to be combined from a single high-pressure air compressor. The energy efficiency of the whole is comparable with the traditional method and the investment is far lower.

By contrast, the flexibility of production is affected by the "three-in-one" combining of the functions and it becomes more difficult to operate or halt one function without affecting the whole.

SUMMARY OF THE INVENTION

It is an object of this invention to be able to combine the economic advantages of the integrated methods while at the same time retaining the flexibility offered by the traditional methods.

One subject of the invention is a method of producing at least one air gas using cryogenic distillation in a system of columns comprising at least one medium-pressure column operating at a medium pressure and a low-pressure column operating at a low pressure, these being thermally coupled to one another and in which, in a first and a second operating mode:

a) all of a compressed air stream is raised to a high pressure, at least 5 bar above the pressure of the medium-pressure column, and purified at this high pressure, known as the main pressure;

b) this main pressure is possibly variable according to the products demanded;

c) a first part of the air stream at least the main pressure is cooled in a heat exchange line down to an intermediate temperature thereof and is expanded in at least a first turbine;

d) possibly a second part of the air stream is expanded in at least a second turbine the admission and delivery conditions of which differ by at most 5 bar and by at most 15° C. or are identical in terms of pressure and temperature to those of the first turbine;

e) possibly the work provided by the first or a third turbine is used at least in part for the work required by a supercharger;

f) the admission pressure of the first turbine is very substantially higher than the medium pressure and possibly higher than the main pressure;

g) the delivery pressure of the first turbine is greater than or equal to the medium pressure, preferably substantially equal to the medium pressure;

h) a/the supercharger compresses at least a fraction of the air stream to a high pressure, greater than or equal to the main air pressure, cooled in the heat exchange line down to a cryogenic temperature (≤100° C.), and returns the supercharged stream to the heat exchange line in which at least part becomes liquefied at the cold end and is then sent into the system of columns following expansion;

i) a pressurized liquid product from the system of columns is vaporized in the heat exchange line;

and in the first operating mode:

j) an auxiliary turbine admits a gaseous fraction of the air stream, said fraction having been expanded beforehand in the first turbine and/or the second turbine, preferably after having been warmed in the main heat exchange line;

k) the admission pressure of the auxiliary turbine differs by less than 2 bar abs from the medium pressure, preferably being substantially equal to the medium pressure;

l) the delivery pressure of the auxiliary turbine is greater than or substantially equal to atmospheric pressure, preferably substantially equal to the low pressure;

m) at least part of the air stream expanded in the auxiliary turbine is warmed in the heat exchange line and is discharged into the atmosphere;

n) some of the constituents of the air are produced by way of end product in liquid form;

and, in the second operating mode:

o) the flow rate of the air stream processed in the auxiliary turbine is reduced, by comparison with the stream processed in the auxiliary turbine in the first mode, possibly to zero; and p) the production of liquid by way of end product is decreased by comparison with the production of liquid by way of end product in the first mode, possibly to zero.

According to other optional aspects:

- all the turbines are braked by an air supercharger;
- at least one supercharger coupled to one of the turbines admits at ambient temperature;
- of all the superchargers, only the supercharger mechanically coupled to the first turbine has an admission temperature of below −100° C.;
- the admission temperature of the first turbine differs by at most ±15° C. from the oxygen pseudo-vaporization temperature;
- the flow rate of the incoming main air is reduced, during the second mode, preferably by a flow rate at least equal to the reduction in the flow rate of air sent to the auxiliary turbine during the second mode;
- the variation in main air flow rate is afforded by the variable vanes of a compressor;
- the variation in main air flow rate is afforded by starting and/or stopping an auxiliary air compressor;

the main air pressure varies between the first mode and the second mode;

the first part of the air is supercharged to a pressure higher than the main pressure upstream of the first turbine so that it enters the first turbine substantially at a pressure higher than the main pressure;

the admission temperature of the auxiliary turbine is at least equal to, even higher than, the admission temperature of the first turbine.

What is proposed here is an improvement in the production flexibility of the single-machine type methods as described hereinabove:

either by offering the option of reducing or even canceling liquid production of the units using a method like the one described in EP-A-0504029;

or by offering the option of producing liquids efficiently using methods such as those described in FR-A-2688052;

and by offering the option of doing one or the other reversibly, and with good energy efficiency in both instances.

This method employs a known distillation system (medium-pressure and low-pressure columns thermally coupled to one another, possibly an intermediate-pressure column and/or a mixing column and/or an argon mixture column, etc.) and involves at least two expansion turbines.

Two flow rates are at substantially equal pressure if their pressures differ only by the pressure drops.

The gaseous fraction of the air stream admitted by the auxiliary turbine is expanded beforehand in the first and/or the second turbine, possibly sent to the medium-pressure column and withdrawn from the medium-pressure column before being sent to the auxiliary turbine after having been warmed in the main heat exchange line.

In the first operating mode, the production of liquid product, all end products combined, constitutes 1% or 2% or 5% of the air stream sent to the columns (or to the column if only the medium-pressure column is supplied with air).

DETAILED DESCRIPTION OF THE INVENTION

For a further understanding of the nature and objects for the present invention, reference should be made to the detailed description, taken in conjunction with the accompanying drawing, in which like elements are given the same or analogous reference numbers and wherein:

The invention will be described in greater detail with reference to the figures, which show air separation plants capable of operating on the method of the invention.

Figure 1:
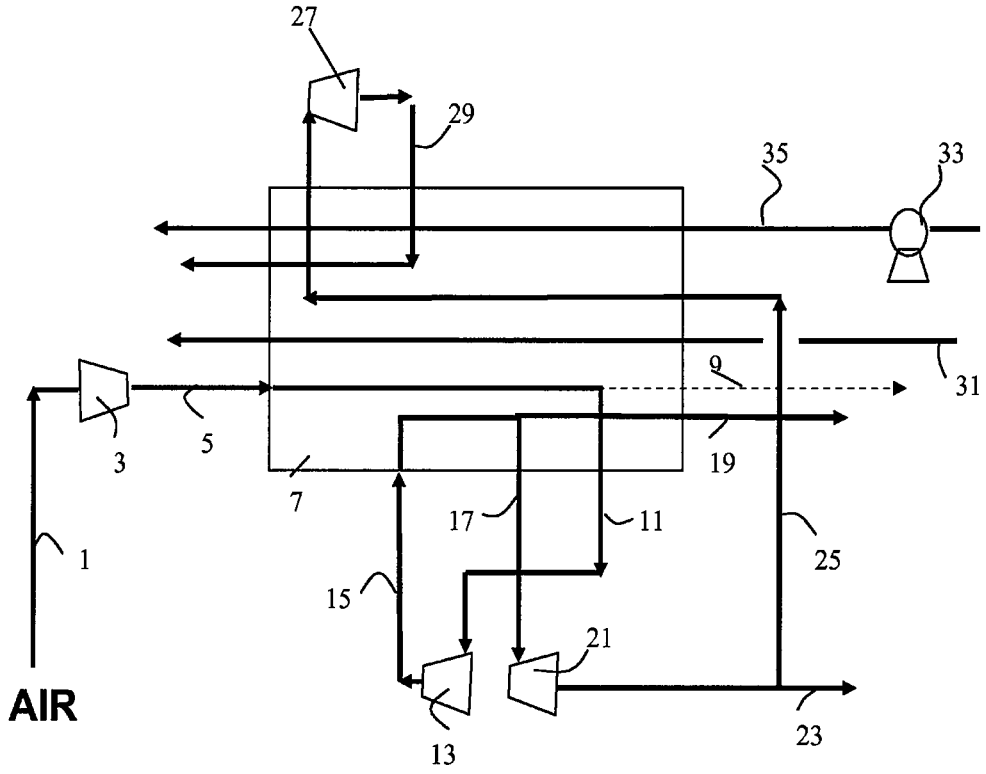
FIG. 1 illustrates one embodiment of the present invention.

In FIG. 1, a compressed air stream 1 from a main compressor is supercharged in a supercharger 3 to a high pressure of at least 5 bar abs above the pressure of the medium-pressure column, this high pressure being known as the main pressure. This main pressure may, for example, be between 10 and 25 bar abs. At this main pressure, the stream 5 is then purified in respect of water and carbon dioxide (not illustrated). The total supercharged and purified air stream 5 is sent to a heat exchange line 7 where it is cooled down to a temperature T1. At that temperature, the stream 5 is split into two to form a stream 9 which becomes liquefied and is sent to the system of columns and a stream 11. The stream 11 leaves the heat exchange line 7 at the temperature T1 and is sent to a cold supercharger 13 to produce a stream 15 at a pressure very substantially higher than the medium pressure and possibly higher than the main pressure. The stream 15 at a temperature T2 as it leaves the cold supercharger is cooled in the heat exchange line 7 down to a temperature T3 higher than T1. At this temperature T3, the stream 15 is split into two streams 17, 19. The stream 17 is expanded in a turbine 21 from the temperature T3 close to the pseudo-vaporization temperature of the pressurized oxygen 33.

The admission pressure of the turbine 21 is equal to the delivery pressure of the supercharger 13 and therefore very substantially higher than the medium pressure (at least 5 bar higher) and possibly higher than the main pressure and the delivery pressure is greater than or equal to the medium pressure, preferably substantially equal to the medium pressure. The stream expanded to a pressure greater than or equal to the medium pressure, preferably substantially equal to the medium pressure, is split into two fractions 23, 25. The stream 19 continues to be cooled in the heat exchange line and is sent in gaseous form to the system of columns.

The cold supercharger 13 is driven by the turbine 21.

A residual nitrogen stream is warmed in the heat exchange line.

A stream of liquid oxygen 35, pressurized in a pump 33, becomes vaporized in the heat exchange line 7.

Optionally a liquid from the system of columns, other than the liquid oxygen, is pressurized, vaporized in the heat exchange line 7, and then used by way of pressurized product.

According to a first operating mode, the fraction 23 is sent to the medium-pressure column of the system in gaseous form, whereas the fraction 25 is returned to the cold end of the heat exchange line 7. At a temperature T4 of below −100° C. and higher than T2, the fraction 25 is sent to a turbine 27 where it is expanded to a temperature T5 forming an air stream 29. This air stream is then warmed in the heat exchange line 7 before being discharged into the atmosphere so that the distillation is not disturbed.

A liquid product is withdrawn from the system of columns by way of end product 32. In the example, the only liquid product of the apparatus is liquid oxygen but other products could obviously be produced.

According to a second operating mode, the flow rate of the air stream 25 processed in the auxiliary turbine 27 is reduced possibly to zero, the flow rate of the incoming main air stream 1 is reduced by a flow rate at least equal to the reduction in the flow rate of the air sent to the auxiliary turbine 27 and the production of liquid 32 is decreased, possibly to zero.

As a preference, the turbine 21 is driven by the supercharger 13 and the supercharger 3 drives the auxiliary turbine 27.

Figure 2:
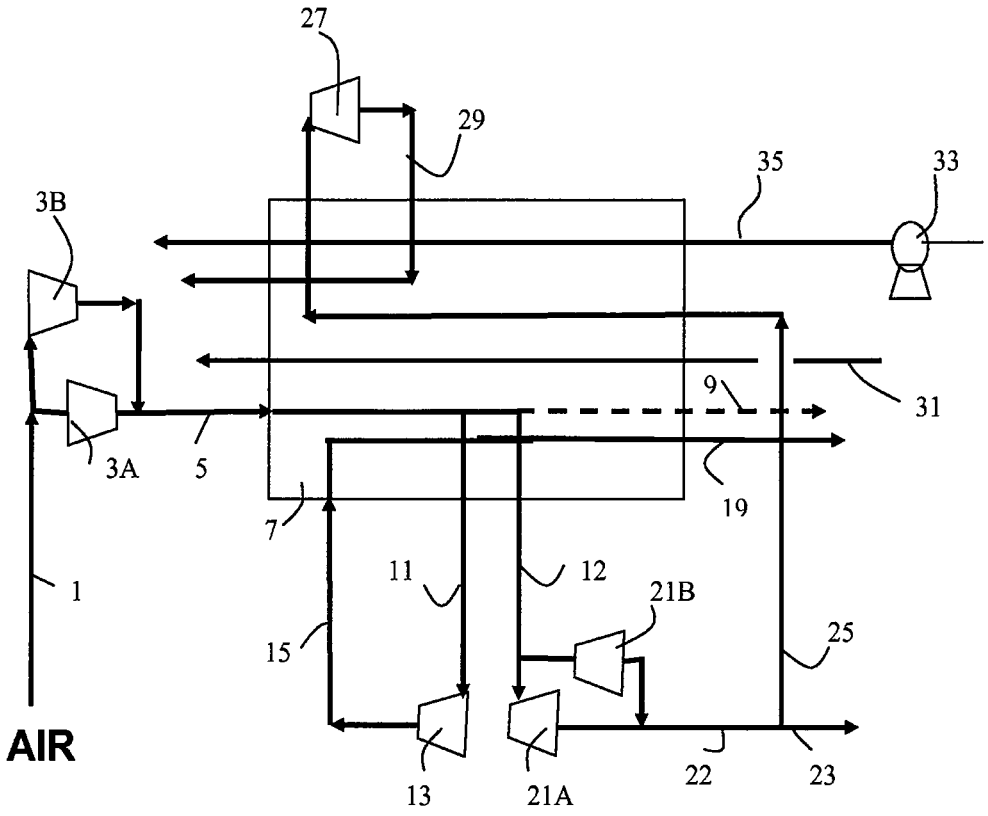
FIG. 2 illustrates another embodiment of the present invention.

In FIG. 2, a stream 1 of compressed air coming from a main compressor is supercharged in two identical superchargers 3A, 3B in parallel at a high pressure of at least 5 bar abs above the pressure of the medium-pressure column, this high pressure being called the main pressure. This main pressure may for example be between 10 and 25 bar abs. The streams from the two superchargers are combined to form a single stream which is then purified of its water and carbon dioxide (not illustrated). The combined, supercharged and purified air stream 5, deriving from the two superchargers, is sent to a heat exchange line 7 where it cools down to a temperature T1. At this temperature, the stream 5 is split into two, so as to form a stream 9 which liquefies and is sent to the column system, and a stream 11. The stream 11 leaves the heat exchange line 7 at the temperature T1, which differs by at most ±5° C. from the vaporization temperature of the pressurized oxygen 33 and is sent to a cold supercharger 13 so as to produce a stream 15 at a pressure very substantially higher than the medium pressure and possibly higher than the main pressure. The stream 15 at a temperature T2 leaving the cold supercharger cools in the heat exchange line 7 down to a temperature T3 higher than T1. At this temperature T3, the stream 15 is split into two streams 17, 19. The stream 17 is again split into two, each stream being expanded from the discharge pressure of the cold supercharger 13 in one of two turbines 21A, 21B connected in parallel with an inlet temperature T3 close to the pseudo-vaporization temperature of the pressurized oxygen 33.

The stream 19 continues to be cooled in the heat exchange line and is sent in gaseous form to the column system.

A stream of waste nitrogen is warmed in the heat exchange line.

A stream of liquid oxygen 35 pressurized in a pump 33 vaporizes in the heat exchange line 7.

According to a first embodiment, the expanded streams coming from the two turbines are combined and then split into two fractions 23, 25. The fraction 23 is sent to the medium-pressure column of the system in gaseous form, whereas the fraction 25 is returned to the cold end of the heat exchange line 7. At a temperature T4 below −100° C. and above T2, the fraction 25 is sent to a turbine 27 where it expands up to a temperature T5, forming an air stream 29. This air stream is then warmed in the heat exchange line 7 before being discharged into the atmosphere, so that the distillation is not disturbed.

A liquid product is withdrawn from the column system as final product 32. In the example, the sole liquid product from the apparatus is liquid oxygen, but of course other products may be produced.

According to a second embodiment, the flow rate of the air stream 25 processed in the auxiliary turbine 27 is reduced possibly to zero, the flow rate of the incoming main air stream 1 is reduced by a flow rate at least equal to the reduction in the flow rate of the air sent to the auxiliary turbine 27 and the production of liquid 32 is decreased, possibly to zero.

Optionally, a liquid from the column system, for example liquid oxygen, is pressurized, vaporized in the heat exchange line 7 and then serves as pressurized product.

In both cases, there may be a compression step between the hot supercharging, which raises the air to the main pressure and the cold supercharging, so that the cold supercharging takes place starting from a pressure above the main pressure.

This variation in the flow rate of the air stream 1 between the two embodiments is afforded by the variable vanes of a compressor and/or by starting and/or stopping an auxiliary air compressor.

These two operating modes may constitute the only operating modes of the apparatus or, alternatively, there may be other operating modes.

Preferably, the turbine 21A is driven by the supercharger 13, the supercharger 3A drives the auxiliary turbine 27, and the supercharger 3B drives the turbine 21B. Any other combination may also be envisioned.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method of producing at least one air gas using cryogenic distillation in a system of columns comprising at least one medium-pressure column operating at a medium pressure and a low-pressure column operating at a low pressure, said at least one median pressure column and low-pressure column being thermally coupled to one another, wherein in a first operating mode and a second operating mode, the method comprises the steps of:

a) pressurizing a compressed air stream to a main pressure that is at least 5 bar above the pressure of the medium-pressure column, and purifying said compressed air stream at this main pressure to produce a main pressure air stream;

b) cooling the main pressure air stream in a heat exchange line to an intermediate temperature $T_1$;

c) removing a first part of the main pressure air stream from the heat exchange line at temperature $T_1$;

d) further cooling a second part of the main pressure air stream within the heat exchange line to a temperature $T_L$ to form a liquefied air stream and sending the liquefied air stream to the system of columns for separation;

e) introducing the first part of the main pressure air stream to a cold supercharger, wherein the first part of the main pressure air stream is pressurized to a high pressure that is greater than or equal to the main pressure to form a supercharged stream;

f) cooling the supercharged stream in the heat exchange line to a temperature $T_3$ that is warmer than temperature $T_1$;

g) removing a first part of the supercharged stream from the heat exchange line at temperature $T_3$;

h) further cooling a second part of the supercharged stream within the heat exchange line before introducing the second part of the supercharged stream to the system of columns for separation;

i) introducing the first part of the supercharged stream to a first turbine, wherein the first part of the supercharged stream is expanded to a pressure that is greater than or equal to the medium pressure to form a first expanded stream;

j) introducing at least a portion of the first expanded stream to the system of columns; and k) vaporizing a press zed liquid product from the system of columns in the heat exchange line, wherein in the first operating mode, the method further comprises the steps of:

l) warming a second portion of the first expanded stream in the heat exchange line to form a warned stream;

m) introducing the warmed stream to an auxiliary turbine and expanding the warmed stream to form an expanded auxiliary stream; and n) warming said expanded auxiliary stream in the heat exchange line and discharging said warm expanded auxiliary stream into the atmosphere, wherein in the second operating mode, the method further comprises the steps of:

o) reducing the flow rate of the second portion of the first expanded stream processed in the auxiliary turbine as compared to the first mode; and p) decreasing the production of liquid by way of end product by comparison with the production of liquid by way of end product in the first mode, wherein the flow rate of the compressed air stream is reduced, during the second mode by a flow rate at least equal to the reduction in the flow rate of the portion of the first expanded stream sent to the auxiliary turbine during the second mode.

2. The method of claim 1, in which the first turbine is braked by an air supercharger.

3. The method of claim 1, in which the cold supercharger is coupled to a turbine selected from the group consisting of the first turbine and the auxiliary turbine.

4. The method of claim 1 wherein the supercharger is mechanically coupled to the first turbine and has an admission temperature below −100° C.

5. The method of claim 1, in which the main pressure varies between the first mode and the second mode.

6. The method of claim 5, in which the variation in the compressed air stream flow rate is afforded by variable vanes of a compressor.

7. The method of claim 5, in which the variation in the compressed air stream flow rate is afforded by starting and/or stopping an auxiliary air compressor while keeping a main air compressor running, wherein the auxiliary air compressor and the main air compressor are installed in parallel.

8. The method of claim 1, wherein a second part of the supercharged stream is expanded in a second turbine the admission and delivery conditions of which differ by at most 5 bar and by at most 15° C. or are identical in terms of pressure and temperature to those of the first turbine.

9. The method of claim 1, wherein the work provided by the first turbine is used at least in part for the work required by the supercharger.

10. The method of claim 1, wherein the admission pressure of the first turbine is substantially higher than the medium pressure.

11. The method of claim 1, wherein the admission pressure of the first turbine is higher than the main pressure.

12. The method of claim 1, wherein the delivery pressure of the first turbine is greater than or equal to the medium pressure.

13. The method of claim 1 wherein the delivery pressure of the first turbine is substantially equal to the medium pressure.

14. The method of claim 1, further comprising a second turbine in parallel configuration with the first turbine and in fluid communication with the auxiliary turbine, such that the cooled first part is also expanded in the second turbine to form a second expanded stream, wherein at least a portion of the second expanded stream is then sent to the auxiliary turbine along with the portion of the first expanded stream.

15. The method of claim 1, wherein the admission pressure of the auxiliary turbine differs by less than 2 bar abs from the medium pressure.

16. The method of claim 1, wherein the admission pressure of the auxiliary turbine is substantially equal to the medium pressure.

17. The method of claim 1, wherein the delivery pressure of the auxiliary turbine is greater than or substantially equal to atmospheric pressure.

18. The method of claim 1, wherein the delivery pressure for the auxiliary turbine is substantially equal to the low pressure.

19. The method of claim 1, wherein some of the constituents of the air are produced by way of end product in liquid form.

20. The method of claim 1, wherein the flow rate of the second portion of the first expanded stream processed in the auxiliary turbine during the second mode is zero.

21. The method of claim 1, further comprising decreasing the production of liquid by way of end product by comparison with the production of liquid by way of end product in the first mode, to zero.

* * * * *